US006874560B2

(12) United States Patent
Escribano

(10) Patent No.: US 6,874,560 B2
(45) Date of Patent: Apr. 5, 2005

(54) ROLLABLE BLIND

(76) Inventor: José Antonio Muñoz Escribano, Luis Beleno Alarcón 1187, Calicanto-Torrento, Valencia (ES)

( * ) Notice: Subject to any disclaimer, the term of this patent is extended or adjusted under 35 U.S.C. 154(b) by 0 days.

(21) Appl. No.: 10/437,894

(22) Filed: May 15, 2003

(65) Prior Publication Data

US 2004/0020610 A1 Feb. 5, 2004

(30) Foreign Application Priority Data

May 16, 2002 (ES) ..... 200201245 U

(51) Int. Cl.[7] ..... E06B 9/08
(52) U.S. Cl. ..... 160/133; 160/235
(58) Field of Search ..... 160/133, 235, 160/232, 236, 273.1, 35, 36

(56) References Cited

U.S. PATENT DOCUMENTS 5,265,663 A * 11/1993 Munekata et al. ..... 160/133
5,575,322 A * 11/1996 Miller ..... 160/133
5,586,592 A * 12/1996 McGregor ..... 160/133
5,850,862 A * 12/1998 Miller ..... 160/133
6,085,822 A * 7/2000 Miller ..... 160/133

* cited by examiner

*Primary Examiner*—David Purol
(74) *Attorney, Agent, or Firm*—Breiner & Breiner, L.L.C.

(57) ABSTRACT

A rollable blind is described including a set of blind slats connected to a set of connecting sections inserted between each pair of slats in the set of blind slats. The connecting sections can turn at their geometric center when a pushing force is exerted by adjacent slats positioned below the connecting sections. This in turn locks the connecting sections in guide channels present in the blind and wedges ends of the connecting sections in place which prevents the blind from being yanked open.

2 Claims, 1 Drawing Sheet

ROLLABLE BLIND

FIELD OF INVENTION

The invention relates to an improved rollable blind that can be used to cover wall openings. The rollable blind includes a set of blind slats that are connected by a set of connecting sections inserted between each pair of slats of the set of blind slats, wherein this is done in such a way that the sections turn around their geometric center at the connection point when they are subjected to the pushing force of adjacent blind slats under them and are shifted sideways in guide channels of the blind against those that are wedged by their ends in order to keep the blind from being yanked open.

BACKGROUND OF INVENTION

The state of the art that is normally employed in making rollable covers for door or window openings calls for rollable covers, also referred to as rollable blinds, with connecting sections inserted between the slats that form the roll-up mechanism. These sections are designed with projections that run longitudinally over the lateral faces of the sections and are designed to wedge against the guides of the rollable cover when an attempt is made to force it open.

Thus, Spanish Utility Model U8900808 discloses a safety device for rollable doors or blinds that is characterized by the fact that the opposing edges of the connecting sections between the successive pairs of slats are covered longitudinally by extensions that are rolled up in opposite directions in order to attach them, with the option of turning, to adjacent open extensions of the respective adjacent slats. If an upward force is applied to the lower slats of the rollable cover, when an abrupt and inappropriate attempt is made to force the rollable cover open, the connecting section is caused to turn around its geometric center and wedges against the slat just above it and, at its ends, wedges at the inside surfaces of the guide channels of the cover in order to keep the blind from being opened.

Owing to the design of the slats of the blind, these devices require that the between-slats connecting section be made in the shape of a hook that is open on both sides and is thus usually designed in the general shape of an S that encompasses the extensions that are rolled up in opposite directions of the adjacent slats. In this way, the connecting section completely takes up the wedging force.

OBJECTS AND BRIEF DESCRIPTION OF THE INVENTION

An object of the invention is to improve upon the rollable blinds or covers that have been known to date by offering an improved rollable blind that is composed of a set of blind slats and a set of connecting sections inserted between each pair of blind slats wherein a primary characteristic includes the way in which the wedging is accomplished, which up until now has been distributed between the connecting section and the slat. Another object of the invention is to ensure that the wedging can be accomplished in a low-cost, convenient, and simple manner.

In order to accomplish these objects, the invention provides an improved rollable blind that includes a set of blind slats that are connected by a set of connecting sections inserted between each pair of slats of the set of blind slats, whereby the sections are made able to turn around their geometric center at the attachment point upon receiving a pushing force from the adjacent slats below them and are shifted sideways in guide channels of the blind, wedging against them at their ends in order to keep the blind from being yanked open.

The invention calls for, and its claims are characterized by, the concept that each slat of the set of blind slats includes a first locking projection that runs over the entire length of the slat and that each of the connecting sections includes a second locking projection that extends longitudinally over the entire section.

The invention also calls for first and second locking projections that extend longitudinally over each of the slats and each of the connecting sections, respectively, to face toward different sides of the blind.

This ensures that, when an attempt is made to yank the blind open, the force normally exerted against its last support slat at the bottom is transmitted toward the upper slats with the support of the connecting sections that attach them, whereby the sections are forced to turn to a small extent at their connection point and to wedge at their ends against a part of the wall that is close to the guide section facing them, in such a way that any slat that is subjected to this force winds up having to tilt and to move toward the nearby blind guide, against which it wedges.

In accordance with a preferred embodiment of the invention, the improved rollable blind is composed of a set of blind slats that are connected by a set of connecting sections inserted between each pair of slats of the set of blind slats.

Each of the blind slats is composed of corresponding hook-shaped extensions that are rolled up and opened on one of the faces of the slat.

In the described sample embodiment, the slat has a first locking projection that runs over its entire length and is located close to the lower hook-shaped extension that originates from the body of the slat. The first locking projection emerges from the body of the slat opposite the opening of the extension in the shape of a hook.

Each of the connecting sections includes corresponding hooks that are open on one face of the section as well as on the other face, while, close to the hook and just below it, is a second locking projection that extends downward over the entire section longitudinally.

In the described embodiment, the second locking projection has been designed as a support step for the upper edge of the body of the blind slat that is located under it at the attachment point.

The present invention will be better understood by reference to the drawings of the specification that show a preferred embodiment of the object of the invention. However, the embodiment shown here and its graphic representation have been chosen solely for purposes of illustration and must not in any way be construed as limiting the particular characteristics of this application.

BRIEF DESCRIPTION OF THE DRAWINGS

FIG. 1 also shows the corresponding home position of the blind.

FIG. 2 shows the positions of the sections and blind slats when wedged against the walls of the lateral blind guide.

DESCRIPTION OF PREFERRED EMBODIMENTS

Figure 1:
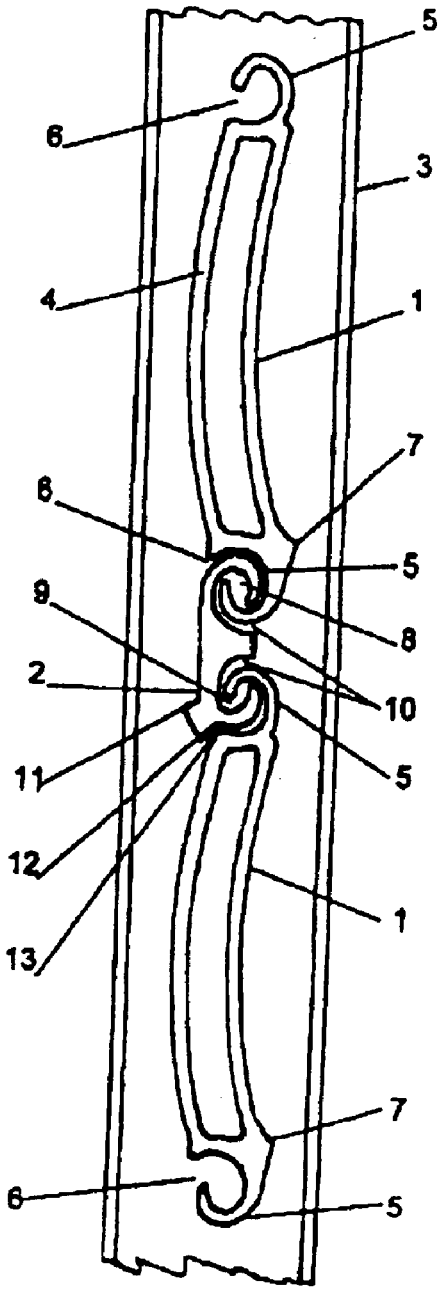
FIG. 1 shows a lateral end portion of an improved rollable blind as claimed for the invention and, in sectional view, between the walls that comprise one of the lateral guides of the blind, it shows a connecting section and corresponding blind slats attached thereto.

From examining the figures, it is easy to see that the improved rollable blind according to the invention is composed of blind slats 1 that are connected by connecting sections 2, whereby the ends of both the slats and the sections are located in blind guides 3 that are provided on both sides of the blind.

Each of the blind slats 1 is formed of a body section 4 that has hook-shaped rolled-up extensions 5 that are opened on one of the faces of the body 4 by means of slots 6.

In the shown example, body section 4 of the blind slat 1 has a first locking projection 7 that extends over its entire length and is close to it, though opposite the opening 6 of the extension 5 that originates below the body 4 of the blind slat 1.

Each of the connecting sections 2 includes corresponding hooks 8 and 9 that are opened by means of slots 10 on one face of the section that forms them, while, facing it and just below the lower hook 9, there emerges from the opposite face of the section 2 a second locking projection 11 that extends over the entire length of the section.

In the shown embodiment, the second locking extension 11 has been designed with a support step 12 for the upper edge 13 of the body of the blind slat 1 that is located below at the connection point.

It is clear that the improved rollable blind in accordance with the invention is composed of a blind panel that is formed by connecting a set of blind slats 1 to a corresponding set of connecting sections 2 that are inserted between adjacent pairs of blind slats.

Since the blind panel is made rollable and is long enough to cover the wall opening in which the blind is to be mounted and, since it is arranged with its ends between the guides 3 that are located at the sides in the wall opening, it is understood that the blind slats 1 hang from the shaft of the blind roll-up drum (not shown in the drawings) and, between them, are located the respective and corresponding connecting sections 2, as shown in FIG. 1.

Figure 2:
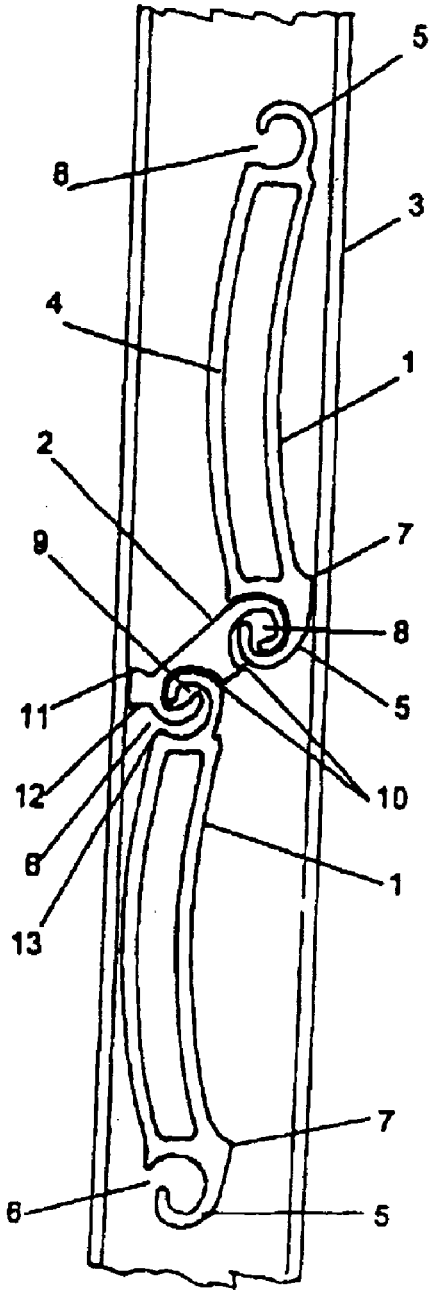
FIG. 2 corresponds to the representation in FIG. 1, with its components also arranged in the same way; however.

It is also clear, as the drawing in FIG. 2 shows, if an attempt is made to yank the blind panel open (which is normally done with a levering force applied to its last support slat at the bottom), the pushing force will be transferred to the upper slats 1 with the support of the connecting sections 2 that attach them to one another, whereby the sections are caused to turn to a small extent at their connection point and wedge at one end against the lower hook 6 of the slat 1 against which it pushes until the first locking projection 7 that extends therefrom wedges against the portion of the wall close to the part of guide 3 facing them, while at the other end the second locking projection 11 that extends therefrom ensures that wedging takes place against the part of the wall close to the part of the guide 3 that the connecting section 2 faces.

While the invention has been described here in the embodiment shown, it is clear that it is possible to modify or replace certain elements or arrangements with equivalent elements or layouts or to add thereto additional devices of known types without thereby departing from the scope and spirit of the invention in its broader aspects.

It is claimed:

1. A rollable blind comprising a set of blind slats, a set of connecting sections, and a set of guide channels, wherein each connecting section of said set of connecting sections is inserted between a pair of slats of said set of slats to thereby connect the pair of slats, said each connecting section of said set of connecting sections being constructed and arranged to be turnable at a geometric center at a point of attachment when a pushing force is exerted by adjacent slats positioned below said each connecting section in order to wedge an end of said each connecting section against a respective guide channel of said set of guide channels to lock the connecting section in place, wherein each slat of said set of slats includes a first locking projection which extends over a length of said slat, and wherein said end of said each connecting section of said set of connecting sections includes a second locking projection which extends over a length of said connecting section.

2. The rollable blind according to claim 1, wherein said first locking projection and the second locking projection face different sides of the blind.

* * * * *